United States Patent [19]

Crutcher

[11] Patent Number: 4,934,597

[45] Date of Patent: Jun. 19, 1990

[54] FOUNTAIN ATTACHMENT FOR A FAUCET

[76] Inventor: William C. Crutcher, Munson Rd., Middlebury, Conn. 06762

[21] Appl. No.: 334,353

[22] Filed: Apr. 7, 1989

[51] Int. Cl.[5] ..... B05B 17/08

[52] U.S. Cl. ..... 239/27; 239/447

[58] Field of Search ..... 239/25, 27, 289, 447

[56] References Cited

U.S. PATENT DOCUMENTS

| | | | |
|---|---|---|---|
| 2,524,956 | 10/1950 | Brunetti | 299/9 |
| 2,661,237 | 12/1953 | Swartz | 239/27 |
| 2,747,930 | 5/1956 | Hyde | 299/11 |
| 3,101,174 | 8/1963 | Loveland | 239/27 |
| 3,443,753 | 5/1969 | McDonnell | 239/27 |
| 3,462,080 | 7/1969 | Howard et al. | 239/27 |

*Primary Examiner*—Andres Kashnikow
*Assistant Examiner*—Michael J. Forman

[57] ABSTRACT

A plastic fountain attachment for a faucet is either cast or injection molded in a single piece or fabricated from separate parts. A tubular body is adapted for attachment to the discharge end of a water faucet and has a discharge opening inclined to its axis. The body has a short wall portion and a diametrically opposed long wall portion extending between said upper and lower ends. A substantially flat closure member is flexibly attached to the outside surface of the short wall portion. The closure member extends downwardly from said short wall portion when unflexed so as not to impede water discharge. The closure member is sufficiently large and so located to enable it to cover the discharge opening when flexed. A fountain outlet directs a jet of water for drinking when the closure member is flexed to cover the discharge opening, the fountain outlet including a hole defined in the long wall portion of the tubular body.

7 Claims, 2 Drawing Sheets

FOUNTAIN ATTACHMENT FOR A FAUCET

BACKGROUND OF THE INVENTION

This invention relates generally to water drinking fountains and more particularly relates to an improved fountain attachment for a water faucet, especially a water faucet equipped with an aerator.

Many fountain attachments for water faucets have been proposed in the past which let the faucet serve the dual purpose of discharging a stream of water downwardly for utilitarian purposes and also direct a jet of water upwardly for drinking directly from the jet. These prior art faucet fountain attachments have generally employed pivotable members designed to allow the discharge of water in one position and to direct the flow of water in a drinking jet in another pivoted position.

Arrangements for locating the hinge of a pivotable member to block or deflect the flow, as well as provision for special internal flow passages have led to bulky and awkward constructions which are expensive, unsightly and which can impede normal utilitarian use of the faucet.

One arrangement for a faucet fountain employs an arcuate tube with a pair of arms pivotably connected to a faucet aerator so that it can be lowered to intercept the water stream and deflect it upwardly for drinking. This device is designed to operate with an aerator of a particular design with holes in its sidewall.

Another arrangement employs a tubular body with internal pivotable deflector and a counterweight located in the fountain discharge chamber to cause the water to issue from the fountain outlet at low flows but to swing open at high flows for utilitarian use of the faucet. This device requires an internal pivot pin and proper adjustment to function.

Still another arrangement utilizes a plastic body designed to frictionally fit over the end of an aerator and having a hinged pivotable deflector vane with a spring biasing the vane toward a closed, or sometimes open, position. This device employs protruding hinge and fountain chamber with special springs required.

It would be desirable to have an easily attachable and detachable faucet fountain which is inexpensive, which does not require any adjustment, and which does not impede normal utilitarian use of the water faucet.

Accordingly, one object of the present invention is to provide an improved fountain attachment for a faucet which is simple, inexpensive and requires no adjustments.

Another object of the invention is to provide an improved fountain attachment for a faucet with an aerator which is easy to install and easy to operate.

SUMMARY OF THE INVENTION

Briefly stated the invention is practiced by providing a substantially straight tubular body with a central axis, an upper end adapted for attachment to the discharge end of a water faucet and a depending lower end with a discharge opening inclined to said axis, the body having a short wall portion and a diametrically opposed long wall portion extending between said upper and lower ends, a substantially flat closure member flexibly attached to the outside of said short wall portion, said closure member extending downwardly from said short wall portion when unflexed so as not to impede water discharge, said closure member being sufficiently large and so located to enable it to cover said discharge opening when flexed, and a fountain outlet comprising means for directing a jet of water for drinking when said closure member is flexed to cover the discharge opening, said fountain outlet including a hole defined in the long wall portion of said tubular body.

DRAWING

Other objects and advantages will best be understood by reference to the following description, taken in connection with the accompanying drawings in which.

Figure 1:
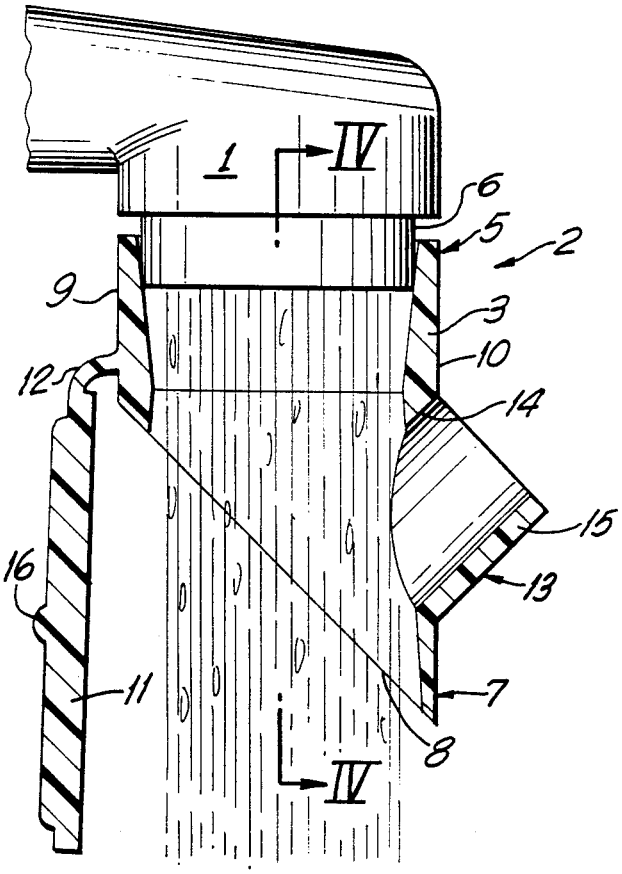
FIG. 1 is a side elevational view, taken in cross section, illustrating a preferred embodiment of my invention as molded in one piece.
Figure 4:
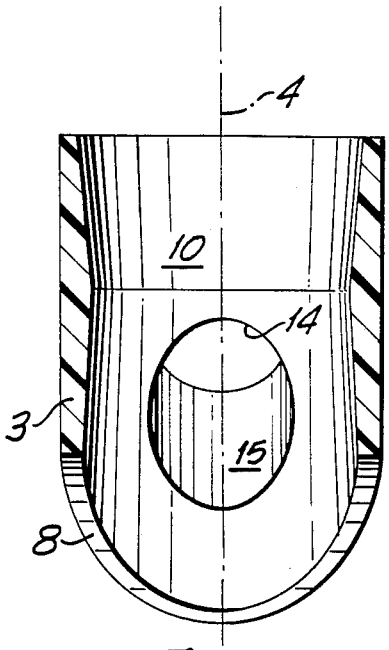
Figure 5:
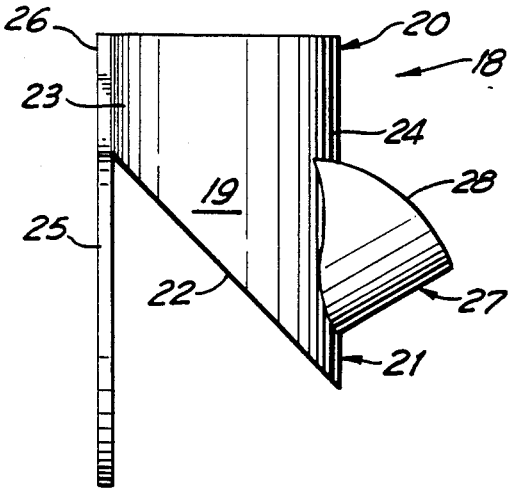
Figure 6:
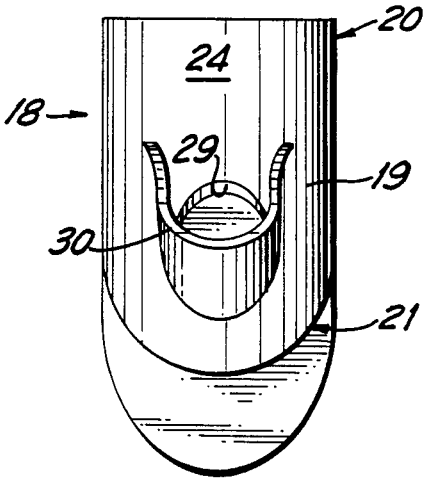
Figure 7:
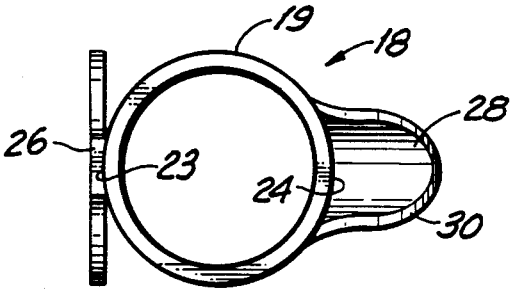
Figure 8:
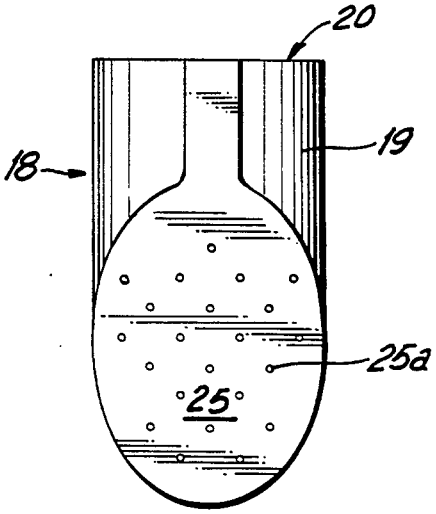
Figure 9:
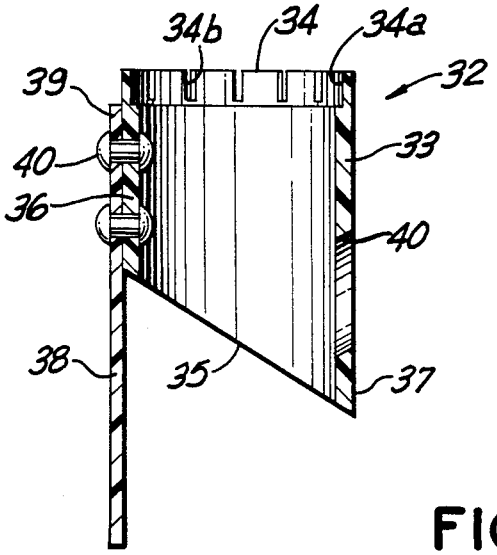

FIG. 4 is a rear elevational view, in cross section taken along lines IV—IV of FIG. 1, FIG. 5 is a side elevational view of a modified form of my improved fountain attachment for a faucet assembled from separate parts, FIG. 6 is a front elevational view of the modified form, FIG. 7 is a top plan view of the modified form, FIG. 8 is a rear elevational view of the modified form, and FIG. 9 is a side elevational view in cross-section, of another modification of the invention.

DESCRIPTION OF THE PREFERRED EMBODIMENT

Referring now to FIGS. 1 through 4 of the drawing, a water faucet 1 is fitted with my improved fountain attachment, shown generally as 2. Attachment 2 is preferably of a plastic material which may be cast or injection molded such as polyurethane or polypropylene. Attachment 2 has a straight tubular body 3 roughly in the shape of a cylindrical tube with a central axis 4. Body 3 has an upper end 5 which is arranged to frictionally engage an aerator 6 extending from the end of faucet 1 by tapering the inside wall of the tubular body as indicated, or by formulating the body material to give sufficient resiliency to expand. In its preferred form the upper end 5 is selected to fit tightly over the end of a standard or generally employed diameter of aerator 6, the type of aerator being immaterial to the present invention.

Body 3 has a lower end 7 depending therefrom which forms a discharge opening for the attachment 2. The lower end 7 terminates in an annular planar edge 8 which is formed on an angle with the axis 4 of the body. The angle is not critical and can vary between 30 and 60 degrees from axis 4. However the fact that the discharge opening from the tubular member is inclined at some appreciable angle with the axis is a very important aspect of the invention.

The body 3 defines a short wall portion 9 and a diametrically opposed long wall portion 10, which are automatically provided by virtue of the inclination of the discharge end to the axis of the tubular body 3. When the attachment 2 is positioned on faucet 1, the short wall portion 9 is located to the rear away from the user, and the long wall portion 10 is facing the user.

Figure 3:
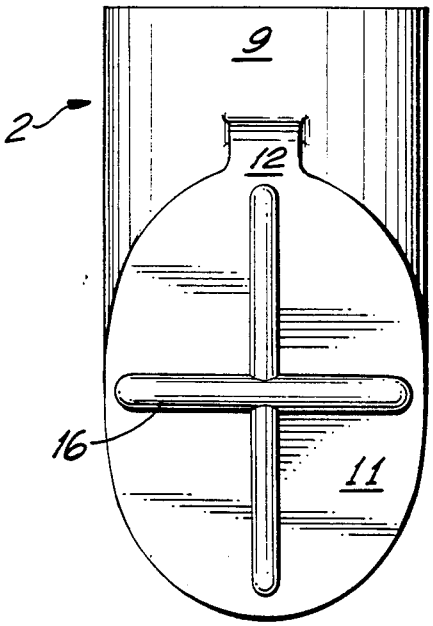
FIG. 3 is a rear elevational view of the FIG. 1 attachment.

Integrally attached to the short sidewall portion 9 is a flexible, substantially flat closure member 11, the shape of which is best seen in FIG. 3 of the drawing. Preferably closure member 11 is formed in a substantially elliptical shape, as will be required if body 3 is cylindrical and the discharge opening is inclined to the axis. The back or underside of the closure member may include molded stiffening ribs 16 to keep it substantially flat and reduce any tendency to curl. An integrally cast or injection molded hinge 12, sometimes referred to as a "living hinge" is provided by a flexible extension of thin or necked cross-section extending from closure member 11. Flexible extension or hinge 12 is integrally joined with the outside surface of the short wall portion 9 during the molding process slightly above the planar edge 8.

The type of plastic selected for molding attachment 2 along with closure member 11 is preferably an FDA approved plastic material which is selected to provide water resistance, toughness and flexibility. Preferably it has a relatively soft surface or may be roughened or scored so as to yield when the closure member is pressed against the planar edge 8 when flexed as will be described.

In order to guide and direct the jet of water for drinking, a fountain outlet shown generally as 13 is provided in the long wall portion 10. Fountain outlet 13 includes a hole 14 defined in the long wall portion and a flow guiding deflector 15 extending from hole 14 and shaped to guide and reduce the velocity of the water jet to make it suitable for drinking.

OPERATION

Figure 2:
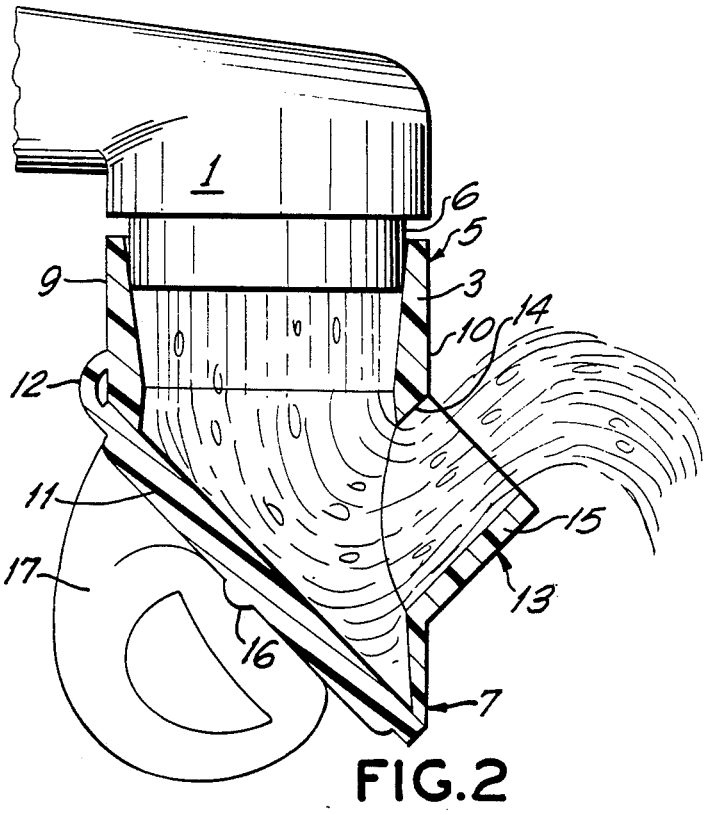
FIG. 2 is a side elevational view in cross section with closure member flexed to illustrate the operation.

The operation of the invention is best understood by reference to FIGS. 1 and 2 of the drawing. In FIG. 1 the flat closure member 11 extends down so as not to impede the use of the faucet for utilitarian purposes such as washing the hands or filling containers. Since the closure member is attached to the outside surface of the tubular member, it does not impede normal water flow. Since the closure member is attached to the short sidewall portion it does not hang down subtantially beyond the bottom of the attachment device as is necessary in some prior art devices which do not have an inclined discharge opening.

FIG. 2 shows closure member 11 being flexed manually by a user's finger 17 to cause the flexible extension or hinge 12 to bend. The intersection of the elliptical closure member with the planar edge 8 closes off the discharge opening from the faucet. This causes water to be directed into the hole 14 in the long sidewall portion and along the deflector 15 from the fountain outlet. Redirecting the water flow is aided both by very slight pressure increase due to closing off the discharge opening from the faucet but more so by deflection due to the inclination of closure member 11 as it fits against the planar edge 8.

It should be further noted that the inclined discharge opening further reduces the degree of bending at the juncture for hinge 12 to undergo. Therefore greater life of the hinge and/or less critical hinge design or material choice is possible.

MODIFICATIONS

Referring now to FIGS. 4–8 of the drawing a modified form of the invention is shown which is fabricated and assembled from parts rather than being cast or injection molded in a single part. By this means although requiring more labor and suited for lower volume, nevertheless quite satisfactory results are obtained. The materials selected for each function may be better suited to that particular function than if the use of the same material is dictated, which sometimes results in compromises.

As shown in side elevation, rear elevation, top plan and rear elevational views of FIGS. 4–8 respectively, the fabricated attachment, shown generally at 18 includes a straight tubular body 19 which is cylindrical having an upper end 20 and a lower end 21. Suitable results have been obtained with a standard polyvinyl chloride pipe of nominal 1 inch (25.4 mm) outside diameter and $\frac{7}{8}$ inch (22.2 mm) inside diameter, which will fit tightly over the end of a popular size of aerator. The lower end 21 of the tubular member forms a discharge opening for attachment 18 and is cut at an angle to the axis of tubular member 19 to provide an annular planar edge 22. The preferred angle is 45 degrees for the pupose of economy of material usage from standard pipe stock, but the angle is not critical and can vary between 30 and 60 degrees from the axis. However the use of an inclined discharge opening terminating the lower end of the body 19 is an important aspect of the invention for reasons previously discussed. A planar edge is also preferrable since it can be formed easily by cutting the tube at an angle with a saw blade rather than employing special tools or molded plastic shapes.

The inclined cut defines on the tubular body a short wall portion 23 at the rear and a long wall portion 24 at the front. Attached to the outside surface of the short wall portion 23 is a substantially flat closure member 25, which is elliptical in shape with an integral extending tab 26. Tab 26 is a flexible extension of flexible sheet material used for closure member 25. I have found that very good results are obtained using polyurethane closed cell foam sheet about 1.5 to 2 mm thickness, which is tough, relatively soft, flexible and has good abrasion resistance. Many other types of materials which have these characteristics such as synthetic rubbers, or even tightly woven textile of synthetic fibers may be employed, since very little pressure difference is experienced by the closure member and leakage through or around it is not a matter of great concern. Small openings **25*a* through the closure member improve its performance in some cases by relieving pressure at the time of closure and reducing any tendency for water to escape at planar edge 22. Openings 25*a*** can be randomly produced as part of the foaming process used to produce the polyurethane sheet material.

Closure member 25 is attached to the outside surface of short sidewall portion 23 by means of tab 26. If polyurethane is used as the material of closure member 25 and polyvinyl chloride pipe is used as the body 19, good attachment is provided by a cyanoacrylate adhesive. Many other adhesives are suitable for this purpose, depending upon the plastics materials selected. Other means of attachment which are satisfactory are ultrasonic bonding, hot gas welding, or the use of plastic or mechanical fasteners which can be upset by application of heat or pressure.

A fountain outlet from body 19 is shown generally at 27, which includes semi-tubular member 28 arranged to direct flow upwardly and away from body 19 when closure member 25 is flexed to close the inclined discharge opening.

Member 28 fits into a hole 29 defined in the long wall portion of body 19. A fully tubular member inserted into hole 29 will serve as a deflector. However, the preferred embodiment as shown in FIGS. 5–6 of the drawings, is a semi-tubular deflector which is cut to the proper shape from a flexible sheet of plastics material, for example PVC of approximately 0.5 to 1 mm thickness bent to fit hole 29. Deflector 28 has a flared lip 30 and is provided with notches 31 (FIG. 5) to assist in proper positioning and holding the semi-tubular deflector, which may be cemented in place with an adhesive. The flaring of lip 30 serves to gradually diffuse and reduce the velocity of the water jet and make it more suitable for drinking.

Flexing of the closure member 25 by pressing in manually with a finger as suggested in FIG. 2 of the drawings, serves to close off the discharge opening, this being immensely aided by the inclined planar surface which reduces the degree of flexing required as well as making operation very easy since a natural action of the finger initiates action of the fountain. The semi-tubular flow deflector directs and diffuses the water jet which is simply redirected by the inclined closure member without any significant pressure buildup.

Reference to FIG. 9 of the drawwing shows yet another modification. There, an attachment 32 is fabricated from parts as before. A cylindical body member 33 has an upper end 34, which is milled out to reduce its wall thickness as at **34*a*, and is provided with short longitudinal circumferentially spaced notches 34*b*. The foregoing particularly adapt the upper end 34** of the attachment to expand to accomodate larger diameter aerators and to assist in frictional engagement of the faucet part or aerator.

The tubular body 33 is cut to provide an annular planar inclined surface 35 as described in connection with FIGS. 4–8, and provide a short wall portion 36 at the rear and a long wall portion 37 at the front. Here, however, the angle of inclination with the tube axis is 60 degrees. An elliptical closure member 38 as described previously in FIGS. 4–8 has a flexible tab 39, which is attached to the outside surface of the short wall portion 36 by plastic heat deformable rivets.

A fountain outlet is provided by hole 14 drilled at an angle of sixty degrees from the tube axis into the long wall portion 37. A flow guiding deflector is not absolutely necessary, since if the wall thickness of body 33 is sufficient and if the hole 40 is drilled at an upwardly inclined angle, then the jet will be directed upwardly by virtue of the inclination of the closure member and the angle of hole 40, due to the flow directing effect of the edges of hole 40.

Other modifications will become apparent to those skilled in the art and it is desired to secure in the appended claims all such modifications as fall within the true spirit and scope of the invention.

What is claimed is:

1. An improved fountain attachment for a water faucet having a discharge end, comprising:

a substantially straight tubular body with a central axis, an upper end adapted for attachment to the discharge end of a water faucet and a depending lower end with a discharge opening inclined to said axis, said tubular body having a short wall portion with an outside surface and a diametrically opposed long wall portion extending between said upper and lower ends, a substantially flat closure member flexibly attached to the outside surface of said short wall portion and extending downwardly from the short wall portion when unflexed so as not to impede water discharge, said closure member being arranged to be flexed by manually pressing said closure member toward said discharge opening and also being sufficiently large and located to enable it to cover said discharge opening when flexed, and a fountain outlet comprising means for directing a jet of water for drinking when said closure member is flexed to cover the discharge opening, said fountain outlet including a hole defined in the long wall portion of said tubular body.

2. The improvement according to claim 1, wherein said tubular body is substantially cylindrical and wherein said closure member is substantially elliptical and includes a flexible extension joined to the outside surface of said short wall portion, said extension providing a flexible hinge for said closure member.

3. The improvement according to claim 1 wherein said tubular body member and said closure member are comprised of identical plastic material and integrally joined by a plastic flexible hinge member, said hinge member being a living hinge connecting said tubular body short wall portion to said closure member.

4. The improvement according to claim 1, wherein said tubular body is polyvinyl chloride and wherein said closure member is polyurethane sheet material and wherein said closure member includes a tab extending therefrom and joined by attachment means to the outside surface of said short wall portion.

5. The improvement according to claim 1, wherein said fountain outlet includes a flow guiding deflector comprising a semi-tubular member extending from said hole and arranged to direct said jet in a generally upward direction away from said closure member and said tubular body.

6. The improvement according to claim 5, wherein said semi-tubular member comprises a flexible sheet of preselected shape and flexed to fit into said opening at one end thereof, said sheet providing a flared lip to diffuse and reduce the velocity of water issuing therefrom.

7. An improved fountain attachment for a water faucet having a discharge end, comprising:

a substantially straight tubular body of plastic material with a central axis, an upper end adapted for frictional attachment to the discharge end of a water faucet and a depending lower end with a discharge opening inclined at an angle between thirty and sixty degrees to said axis, said tubular body having a short wall portion with an outside surface and a diametrically opposed long wall portion extending between said upper and lower ends, a substantially flat closure member of plastic material having an integral flexible extension connected to the outside surface of said short wall portion, and flexibly attached to said short wall portion, said closure member extending downwardly from the short wall portion when unflexed so as not to impede water discharge, said closure member being substantially elliptical in shape and sufficiently large to enable it to cover said discharge opening when flexed by manually pressing it toward said discharge opening, and a fountain outlet comprising a hole defined in the long wall portion for conducting a jet of water for drinking when said closure member is flexed to cover the discharge opening and a semi-tubular flow guiding member of plastic material extending generally upwardly and away from said tubular body and shaped to direct a jet of water upwardly and away from said tubular body when the closure member is flexed to block the flow of water from said discharge opening.

* * * * *